United States Patent [19]

Wang et al.

[11] 4,110,207

[45] Aug. 29, 1978

[54] PROCESS FOR FLOTATION OF NON-SULFIDE ORES

[75] Inventors: Samuel Shan Ning Wang, Cheshire; Eugene Leroy Smith, Jr., Stamford, both of Conn.

[73] Assignee: American Cyanamid Company, Stamford, Conn.

[21] Appl. No.: 646,450

[22] Filed: Jan. 5, 1976

[51] Int. Cl.[2] ..... B03D 1/02

[52] U.S. Cl. ..... 209/166

[58] Field of Search ..... 209/166, 167; 210/58; 260/485

[56] References Cited

U.S. PATENT DOCUMENTS

| | | | |
|---|---|---|---|
| 2,025,984 | 12/1935 | Harris | 260/404.8 |
| 2,099,120 | 6/1938 | Kirby | 209/166 |
| 2,120,217 | 6/1938 | Harris | 209/166 |
| 2,302,338 | 11/1942 | Mueller | 209/166 |
| 2,312,466 | 3/1943 | Erickson | 209/166 |
| 2,362,432 | 11/1944 | Cahn | 209/166 |
| 2,759,607 | 8/1966 | Boyd | 210/54 R X |
| 2,950,818 | 8/1960 | Mueller | 209/166 |
| 3,419,665 | 12/1968 | Lachampt | 260/485 P |
| 3,779,380 | 12/1973 | Bishop | 209/166 |
| 3,819,048 | 6/1974 | Weimer | 209/166 |
| 3,891,545 | 6/1975 | Petrovich | 209/166 |
| 3,908,310 | 7/1976 | Stovell | 260/485 P X |
| 3,909,399 | 9/1975 | Petrovich | 209/166 |
| 3,923,647 | 12/1975 | Petrovich | 209/166 |
| 3,974,083 | 8/1976 | Suen | 210/58 X |
| 4,020,000 | 4/1977 | Suen | 260/485 G X |
| 4,034,863 | 4/1977 | Wang | 209/160 |

FOREIGN PATENT DOCUMENTS

| | | | |
|---|---|---|---|
| 962,871 | 5/1957 | Fed. Rep. of Germany | 209/166 |
| 1,808,724 | 6/1970 | Fed. Rep. of Germany | 260/485 G |
| 1,355,091 | 5/1974 | United Kingdom | 209/166 |
| 812,255 | 4/1959 | United Kingdom | 260/485 G |

*Primary Examiner*—Robert Halper

*Attorney, Agent, or Firm*—William J. van Loo

[57] ABSTRACT

Process for flotation of non-sulfide ores using partial esters of polycarboxylic acids having the following structure

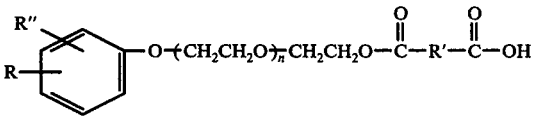

wherein R is an alkyl group of about 4 to 12 carbon atoms, R'' is hydrogen or an alkyl group of up to 12 carbon atoms, *n* is a number 0–3, and R' is a bivalent grouping of a selected class in combination with fuel oil and alkali.

5 Claims, No Drawings

PROCESS FOR FLOTATION OF NON-SULFIDE ORES

This invention relates to an improved process of mineral beneficiation by froth flotation. More particularly, the invention relates to such a process wherein non-sulfide minerals such as phosphate, fluorite, and barite are processed by froth flotation using as collector one of certain novel ethoxylated alkylaryl phenol partial esters of polycarboxylic acids.

Froth flotation is the principal means of concentrating phosphate, barite, and fluorite ores as well as a host of other ores. Its chief advantage is that it is a relatively efficient operation at a substantially lower cost than many other processes.

Flotation is a process for separating finely ground valuable minerals from their associated gangue, or waste, or for separating valuable components one from the other. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends on the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention is not limited by this or other theories of flotation.

Typically, phosphate ore containing about 15–35% BPL (bone phosphate of lime) $Ca_3(PO_4)_2$, is concentrated in very large tonnages from the Florida pebble phosphate deposits. The ore slurry from strip mining is sized at about 1 millimeter and the coarser, after scrubbing to break up mud balls, is a finished product. The minus 1 mm fraction is further sized at 35 and 200 mesh. The minus 200 mesh slime is discarded. From the sizing operation the +35 mesh material in thick slurry is treated with fatty acid, fuel oil, and caustic, ammonia, or other alkaline material and the resulting agglomerates are separated on shaking tables, spirals, or spray belts. The 35 × 200 mesh fraction is conditioned with the same type of reagents and floated by conventional froth flotation route. Not all the silica gangue is rejected by the fatty acid flotation, so the concentrate is blunged with acid to remove collector coatings, deslimed, washed of reagents and subjected to an amine flotation with fuel oil at pH 7–8. This latter flotation, sometimes called "cleaning", removes additional silica and raises the final concentrate grade to 75–80% BPL.

Although the procedure described above is effective in the recovery of BPL from phosphate rock, there nevertheless exists the need for more effective collectors which will provide increased recovery of phosphorus values while still providing high grade recovery. In view of the high quantities of phosphate rock processed by froth flotation, such a development can result in a substantial increase in the total amount of phosphorus values recovered and provide substantial economic advantages even when a modest increase in recovery is provided. Accordingly, the provision for an improved process for froth flotation of non-sulfide minerals would fulfill a long-felt need and constitute a notable advance in the art.

In addition, the acids currently employed are derived from vegetable oils, which represent scarce edible oil stocks used for nutritional purposes. Provision for a froth flotation process based on acids that are more abundantly available and are not derived from the scarce edible oil stocks would give rise to an abundant source for useful acids and free the natural oils for nutritional purposes. This provision of itself is a significant contribution to the art in view of the continuing and ever-increasing scarcity of edible oil stocks.

Because of the scarcity of the naturally derived acids conventionally employed in the froth flotation of non-sulfide minerals, there has been much activity to provide alternative acids that would release the edible oil stocks for nutritional purposes while providing synthetic acids that would provide good performance in froth flotation. Certain acids that have been provided are partial esters of polycarboxylic acids wherein the esterifying alcohol is an ethoxylated aliphatic alcohol. Such partial esters cause excessive foaming in froth flotation. This excessive foaming is believed to arise from the fact that the ethoxylated aliphatic alcohols represent mixtures of compounds of varying degrees of ethoxylation. Fractionation of the ethoxylated alcohols is expensive to achieve and can lead to decomposition. Use of such acids in froth flotation can require the added use of defoamers which add to treatment costs.

In accordance with the present invention, there is provided a process for recovering non-sulfide minerals which comprises classifying the mineral to provide particles of flotation size, slurrying the sized mineral in aqueous medium, conditioning the slurry with effective amounts of fuel oil, alkali, and a partial ester of a polycarboxylic acid having at least one free carboxylic acid group, and floating the desired mineral values by froth flotation, said partial ester having the structure

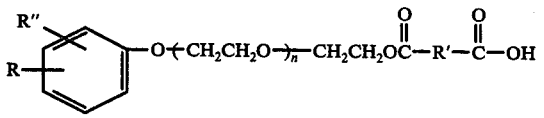

wherein R is an alkyl group of about 8 to 12 carbon atoms, R'' is hydrogen or an alkyl group of up to about 12 carbon atoms, $n$ is a number 0–3, and R' is a bivalent grouping selected from $(CH_2)_m$ wherein $m$ is an integer of 1–6,

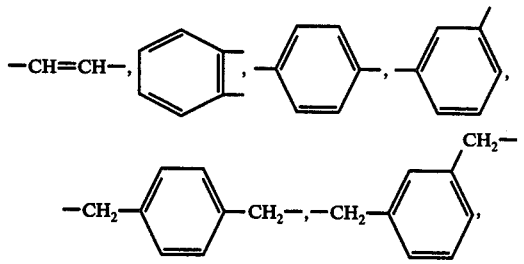

-continued

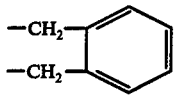

, and $-C_6H_{10}-$.

There is also provided a partial ester of a polycarboxylic acid having the structure

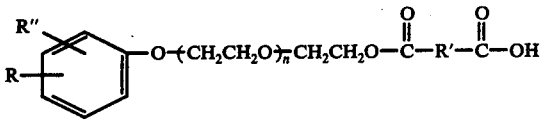

wherein R, *n*, R′, and R″ have the significance previously given.

Use of the specified acids provides unexpected improvements in recovery of valuable minerals at high grade, a purity, levels under normal froth flotation conditions. These acids are readily degraded to permit recycle of process streams. The present acids are readily dispersed in aqueous systems providing efficient coverage of the mineral surface. The acids are stable for practical periods under froth flotation conditions. The acids resist deposition and inactivation by normal or excessive water hardness ions such as soluble calcium and magnesium compounds (carbonates, bicarbonates, hydroxides, etc.).

The acids used in the present process are provided by synthesis utilizing specific carboxylic acids and esterifying agents. These synthetic acids are moderate in cost, provide greater recovery of usable mineral per unit cost, and are more readily available than currently used reagents. The synthetic acids can be produced in more consistent, predictable purity and quality than naturally derived, scarce products. The acids of the present process will release scarce edible oil stocks for nutritional purposes.

In preparing the acids of the present invention, a suitable ethoxylated alkylphenol is reacted with selected polycarboxylic acid under conventional procedures to provide a partial ester leaving at least one free carboxylic acid on the polycarboxylic acid. The alkylphenol will generally contain from about 4 to 12 carbon atoms in the R alkyl group, preferably 8 to 12 carbon atoms such as octylphenol, nonyl phenol and dodecylphenol. These alkyl carbon atoms may be of straight or branched chain. The alkyl position may be ortho, meta or para or mixtures thereof. Dialkylphenols are also suitable. Ethoxylation of the aromatic hydroxyl group will be such as to provide 1 to 6 oxyethylene groups, or in the formula

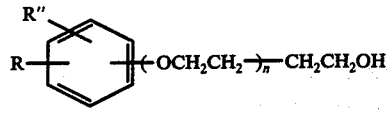

*n* will have a value of 0–5. These ethoxylated alkylphenols are readily available from a number of suppliers and their preparation has been described in the literature.

Polycarboxylic acids that can be esterified to provide the partial esters of the present invention include, for example, malic, maleic, citric, tartaric, succinic, adipic, phthalic, cyclohexyl dicarboxylic, terephthalic, and similar acids. Preferably, the polycarboxylic acid used in forming the partial ester is maleic acid.

A convenient method of preparing preferred partial esters of the present invention is to react equal molar quantities of the ethoxylated alkylphenol and polycarboxylic acid at elevated temperature above the boiling point of water so that any water formed upon reaction is distilled off. It is convenient to employ the acid anhydride, such as maleic anhydride, when available. Alternatively, the free acid or acid chloride may be used. In any event, the esterification reaction will be carried out in accordance with conventional procedures except for the specific reactants employed.

Suitable partial esters include, for example:

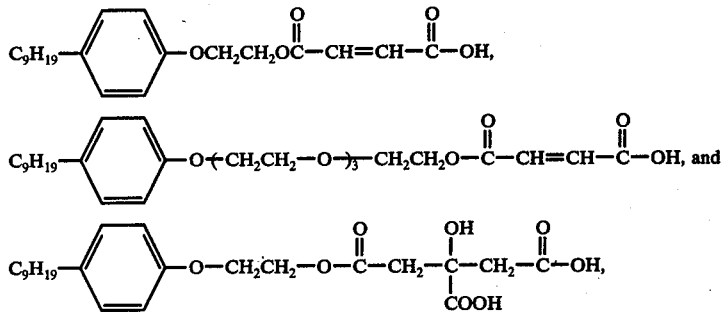

wherein the $C_9H_{19}$ alkyl group of the phenol contains branched isomeric chains.

In carrying out the process of the present invention, a non-sulfide mineral is selected for treatment. Such minerals include phosphate, fluorite, barite, and the like that are conventionally processed by froth flotation. The selected mineral is screened to provide particles of flotation size according to conventional procedures. Generally, the flotation size will encompass from about 35 × 200 mesh size.

After the selected mineral has been sized as indicated, it is slurried in aqueous medium and conditioned with acid, fuel oil, and alkali in effective amounts in accordance with conventional procedures. Generally, the slurry is conditioned at pasty consistency in the range of about 50 to 75% solids, preferably about 65–70% solids. Generally, the acid and fuel oil is used as a mixture in the ratio of about 2/1 to 1/4 acid/oil such as to provide a level of about 0.1 to 2.0 lbs. of acid per ton of mineral, although variations in amounts will occur with the specific mineral being processed within conventional ranges. The fuel oil is used to suppress froth formation and will vary as necessary depending on the extent to which excessive frothing occurs.

Alkali usage will be within conventional limits and is that necessary to provide the pH value at which froth flotation is to be accomplished. The pH value is generally on the alkaline side but specific values will vary depending upon the mineral processed and the combination of recovery and grade desired. Generally the pH value will range from about 6.0 to 12.0, usually 8.0 to 10.0.

As the acid used in accordance with the present invention, there is employed one having the general structure

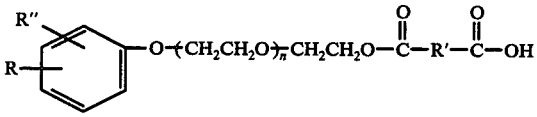

wherein R is an alkyl group of about 4 to 12 carbon atoms, R'' is hydrogen or an alkyl group of up to about 12 carbon atoms, $n$ is a number 0–5, and R' is a bivalent grouping selected from $-(CH_2)_m-$ wherein $m$ is an integer of 1–6, —CH=CH—, —CHOHCH—, —CHOHCHOH—, $-CH_2C(OH)(COOH)CH_2-$,

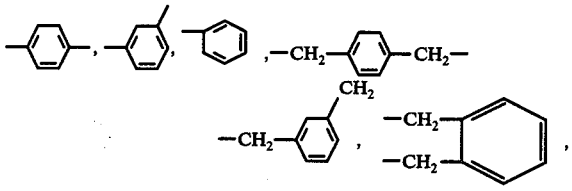

and $-C_6H_{10}-$. Preferred species are those previously indicated.

Suitable non-sulfide minerals processed by the process of the present invention include fluorite or fluorspar, barite or barytes, phosphate rock of the pebble type as found in Florida or foskorite as found in South Africa. Other non-sulfide minerals that are processed by froth flotation using an acid collector may also be processed.

The invention is more fully illustrated by the examples which follow, wherein all parts and percentages are by weight unless otherwise specified. Although the invention is illustrated with phosphate minerals, it is to be understood that similar benefits are obtainable with other minerals as defined. The following general procedure is employed in the froth flotation examples given.

GENERAL PROCEDURE

Rougher Float

Step 1: Secure washed and sized feed, e.g., 35 × 150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal amount of tap water. The water is carefully decanted to avoid loss of solids.

Step 3: The moist sample is conditioned for one minute with approximately 100 cc of water, sufficient caustic as 5–10% aqueous solution to obtain the pH desired, a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct end point. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

EXAMPLE 1

Preparation of

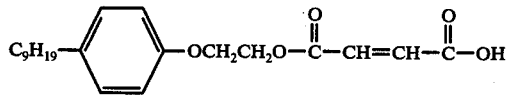

To 264 grams (1 mole) of

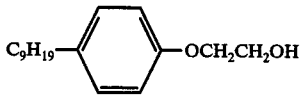

are added 100 grams (1.02 moles) of maleic anhydride. The mixture is heated to 120° C. and held at that temperature until reaction is complete, about 4 hours.

EXAMPLE 2

Preparation of $C_9H_{19}$

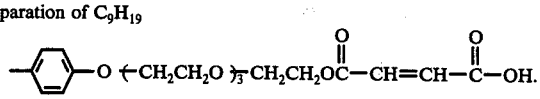

The procedure of Example 1 is followed in every material detail except that in place of the ethoxylated nonylphenol used therein, there is used 396 grams of

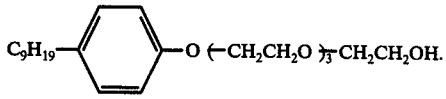

EXAMPLE 3

Preparation of $C_9H_{19}$

-continued

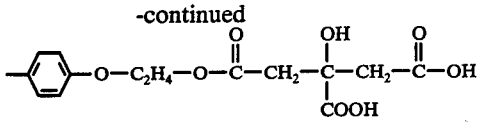

The procedure of Example 1 is again followed in every material detail except that in place of the maleic acid used therein, there is used citric acid in the amount of 196 grams. The reaction was conducted at 85° C. for 20 hours.

EXAMPLE 4

Using as collectors various acids, Florida phosphate rock was processed according to the General Procedure described above. The acid usage and other details as well as the flotation results are given in the table which follows. The pH was 9.55.

For comparison purposes, flotation results obtained with stearic acid, a conventional acid, and with a partial ester of an ethoxylated nonylphenol containing ethoxy group substitution outside the scope of the present invention are also given in the table.

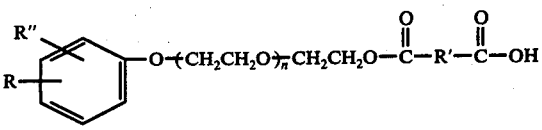

wherein R is an alkyl group of about 8 to 12 carbon atoms, R'' is hydrogen or an alkyl group of up to about 12 carbon atoms, $n$ is a number 0–3, and R' is a bivalent grouping selected from $-(CH_2)_m-$ wherein $m$ is an integer of 1–6, —CH=CH—, —CHOHCH$_2$—, —CHOHCHOH—, —CH$_2$C(OH)(COOH)CH$_2$—,

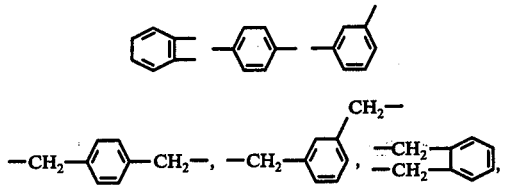

and cyclohexyl.

| PARTIAL ESTER OF EXAMPLE | DOSAGE (lbs./ton) REAGENT | PHOSPHATE FLOTATION RESULTS NO. 5 FUEL OIL | CONCENTRATE (WEIGHT %) | CONC. (% BPL) | TAIL (% BPL) | FEED (% BPL) | RECOVERY (% BPL) |
|---|---|---|---|---|---|---|---|
| 1 | 0.303 | 0.303 | 21.72 | 63.52 | 7.17 | 19.41 | 71.09 |
| 1 | 0.503 | 0.508 | 30.04 | 60.51 | 2.03 | 19.63 | 93.76 |
| 1 | 0.952 | 0.952 | 32.55 | 58.91 | 1.03 | 19.87 | 96.89 |
| 2 | 0.559 | 0.559 | 20.72 | 63.26 | 8.30 | 19.69 | 66.57 |
| 3 | 0.28 | 0.56 | 23.72 | 67.41 | 4.65 | 19.53 | 81.84 |
| 3 | 0.50 | 1.00 | 25.89 | 66.23 | 3.06 | 19.42 | 88.32 |
| 3 | 1.00 | 2.00 | 31.10 | 59.54 | 1.20 | 19.34 | 95.73 |
| COMPARATIVE[1] A | 0.543 | 0.543 | 2.57 | — | — | — | — |
| COMPARATIVE[2] B | 1.01 | 1.01 | 20.33 | 51.50 | 12.30 | 20.27 | 51.65 |
| COMPARATIVE[3] C | 1.3 | 2.60 | 30.17 | 64.26 | 2.84 | 21.37 | 90.72 |

NOTES:

[1] COMPARATIVE A EMPLOYED 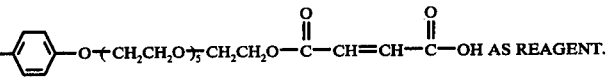 AS REAGENT.

[2] COMPARATIVE B EMPLOYED STEARIC ACID AS REAGENT.

[3] COMPARATIVE C EMPLOYED TALL OIL FATTY ACIDS AS REAGENT.

We claim:

1. A process for recovering non-sulfide minerals which comprises classifying the mineral to provide particles of flotation size, slurrying the sized mineral in aqueous medium, conditioning the slurry with effective amounts of fuel oil, alkali, and a partial ester of a polycarboxylic acid having at least one free carboxylic acid group, and floating the desired mineral values by froth flotation, said partial ester having the structure 2. The process of claim 1 wherein said R' is —CH=CH—.

3. The process of claim 1 wherein said R' is —CH$_2$C(OH)(COOH)CH$_2$—.

4. The process of claim 2 wherein said R contains 9 carbon atoms and said $n$ is 0.

5. The process of claim 3 wherein said R contains 9 carbon atoms and said $n$ is 0.

* * * * *